US012259146B2

(12) United States Patent
Deng et al.

(10) Patent No.: US 12,259,146 B2
(45) Date of Patent: Mar. 25, 2025

(54) INTEGRAL AIR CONDITIONER DEVICE

(71) Applicant: GD MIDEA AIR-CONDITIONING EQUIPMENT CO., LTD., Guangdong (CN)

(72) Inventors: Jingwen Deng, Guangdong (CN); Jingqiang Jiang, Guangdong (CN); Gang Liu, Guangdong (CN)

(73) Assignee: GD MIDEA AIR-CONDITIONING EQUIPMENT CO., LTD., Guangdong (CN)

( * ) Notice: Subject to any disclaimer, the term of this patent is extended or adjusted under 35 U.S.C. 154(b) by 342 days.

(21) Appl. No.: 17/742,691

(22) Filed: May 12, 2022

(65) Prior Publication Data

US 2022/0268454 A1 Aug. 25, 2022

Related U.S. Application Data

(63) Continuation of application No. PCT/CN2020/085357, filed on Apr. 17, 2020.

(30) Foreign Application Priority Data

Nov. 29, 2019 (CN) ..... 201922132295.9

(51) Int. Cl.
*F24F 13/20* (2006.01)
*F24F 1/028* (2019.01)
(Continued)

(52) U.S. Cl.
CPC ..... *F24F 1/028* (2019.02); *F24F 1/029* (2019.02); *F24F 1/0323* (2019.02); *F24F 13/20* (2013.01)

(58) Field of Classification Search
CPC ..... F24F 1/028; F24F 1/0323; F24F 1/029; F24F 13/081
See application file for complete search history.

(56) References Cited

U.S. PATENT DOCUMENTS

2005/0278972 A1* 12/2005 Maruca ..... D06F 58/20 34/212

FOREIGN PATENT DOCUMENTS

CN 201531958 U 7/2010
CN 102455024 A 5/2012
(Continued)

OTHER PUBLICATIONS

International Search Report and Written Opinion dated Aug. 26, 2020 received in International Application No. PCT/CN2020/085357 together with an English language translation.

*Primary Examiner* — Devon Russell
(74) *Attorney, Agent, or Firm* — Scully, Scott, Murphy & Presser, P.C.

(57) ABSTRACT

An integral air conditioner device is provided. The device has an air conditioner body, a condenser and an anti-blow-by structure. The anti-blow-by structure is a box body with openings on two sides of the box body. The opening on one side of the box body is in communication with an air inlet of the air conditioner body. The opening on the other side of the box body faces the condenser. The periphery of the opening that faces the condenser and a frame of the condenser are arranged in a closed manner. In the integral air conditioner device, the anti-blow-by structure is provided between the air inlet and the condenser and one opening of the anti-blow-by structure faces the condenser, such that air fed in through the air inlet can only pass through the condenser and is subsequently exhausted by an air outlet of the air conditioner body.

8 Claims, 6 Drawing Sheets

(51) Int. Cl.
*F24F 1/029* (2019.01)
*F24F 1/0323* (2019.01)

(56) References Cited

FOREIGN PATENT DOCUMENTS

| | | | | | |
|---|---|---|---|---|---|
| CN | 102767893 | A | | 11/2012 | |
| CN | 104074037 | A | * | 10/2014 | ..... D06F 58/24 |
| CN | 204006393 | U | | 12/2014 | |
| CN | 106152307 | A | | 11/2016 | |
| CN | 210921603 | U | | 7/2020 | |
| CN | 211011641 | U | | 7/2020 | |
| CN | 107806446 | B | * | 9/2023 | ..... F04D 25/08 |
| EP | 0940585 | B1 | * | 6/2004 | |
| KR | 20020061764 | A | * | 7/2002 | |
| KR | 20040031211 | A | | 4/2004 | |
| KR | 100481198 | B1 | * | 4/2005 | |
| TW | 201408963 | A | * | 3/2014 | |
| WO | WO-2016142760 | A1 | * | 9/2016 | ..... F24F 13/08 |

* cited by examiner

INTEGRAL AIR CONDITIONER DEVICE

CROSS-REFERENCE TO RELATED APPLICATIONS

The present application is a continuation application of PCT International Patent Application No. PCT/CN2020/085357, filed on Apr. 17, 2020, which claims priority to and benefits of Chinese Application No. 201922132295.9, filed on Nov. 29, 2019, the entire contents of which are incorporated herein by reference for all purposes. No new matter has been introduced.

FIELD

The present invention relates to the field of air conditioners, and more particularly, to an integral air conditioner device.

BACKGROUND

In an existing integral air conditioner, a heat dissipation method of a condenser component in the air conditioner is in such a way that air outside of a machine body of the air conditioner enters the machine body from an air inlet under the action of a wind wheel in a lower air duct of the air conditioner, passes through the condenser, and is subsequently exhausted from the machine body. The air outside the machine body achieves heat dissipation of the condenser when passing through the condenser. However, in the existing integral air conditioner, when the air outside the machine body passes through the condenser, the so-called blow-by phenomenon is likely to occur at the periphery of the condenser, thus reducing the heat dissipation efficiency of the condenser.

SUMMARY

The present disclosure aims to solve at least one of the technical problems existing in related arts to a certain extent. An aspect of the present disclosure provides an integral air conditioner device, which can reduce the blow-by phenomenon during air enters an air conditioner body, and effectively improve the heat dissipation efficiency of a condenser. According to an embodiment of the present disclosure in the first aspect, an integral air conditioner device is provided. The integral air conditioner device includes an air conditioner body, a condenser provided in the air conditioner body, and an anti-blow-by structure. The air conditioner body is provided with a machine body air inlet and a machine body air outlet. A frame of the condenser is arranged around a periphery of the condenser. The anti-blow-by structure is arranged between the machine body air inlet and the condenser. The anti-blow-by structure is a box body with two openings. The openings are respectively located on an opening face of the box body. One opening of the anti-blow-by structure is in communication with the machine body air inlet, and the other opening of the anti-blow-by structure faces the condenser.

The present disclosure at least has the following beneficial effects: the integral air conditioner device is provided with the anti-blow-by structure between the machine body air inlet and the condenser, and an opening of the anti-blow-by structure faces the condenser, such that air entering through the machine body air inlet can only pass through the condenser, and then be exhausted through the machine body air outlet, and the air conditioner device reduces blow-by during air enters an air conditioner body, and can effectively improve a heat dissipation efficiency of the condenser.

According to some embodiments of the present disclosure, the frame of the condenser includes a plurality of first connection edges on a same plane, and the opening of the anti-blow-by structure facing the condenser comprises a plurality of second connection edges around, and the second connection edges are attached and fixed to the first connection edges.

According to some embodiments of the present disclosure, a sealing strip is arranged between the second connection edge and the first connection edge which are attached to each other, and the second connection edge and the first connection edge are fixedly connected.

The opening of the anti-blow-by structure facing the condenser has a periphery that is enclosed around the frame of the condenser. When the integral air conditioner device is assembled, it is necessary to ensure a sealing effect between the opening face of the anti-blow-by structure with the condenser and between the opening face of the anti-blow-by structure with the machine body air inlet, thus more effectively reducing a possibility of blow-by during air entering through the machine body air inlet from entering to exhausting. When the integral air conditioner device is assembled, the condenser is mounted first, and then the box body forming the anti-blow-by structure is mounted. The opening face on one side of the anti-blow-by structure facing the condenser is attached to and mounted with the first connection edges forming the frame of the condenser by the plurality of second connection edges around the opening, which can reduce blow-by occurring at a connection position between the anti-blow-by structure and the condenser. In order to strengthen the sealing effect, the sealing strip may be arranged between the first connection edge and the second connection edge which are attached to and mounted with each other, and fixed by screws to simultaneously ensure a connection strength.

According to some embodiments of the present disclosure, each side of the opening faces of the box body has an opening respectively. The opening face facing the machine body air inlet on one side of the anti-blow-by structure is provided with a plurality of vertical insertion plates, the vertical insertion plates are arranged perpendicular to the opening face. A plurality of slots are arranged around the machine body air inlet in the air conditioner body, and the vertical insertion plates are respectively embedded in the slots for fixation after the air conditioner body is completely assembled.

The machine body air inlet and the machine body air outlet are arranged on a rear shell of the air conditioner body. The rear shell of the air conditioner body is mounted until internal structures such as the condenser and the anti-blow-by structure are completely assembled. When the rear shell of the air conditioner body is mounted, the slots arranged on the periphery of the machine body air inlet are aligned with the vertical insertion plates in a circle arranged on the anti-blow-by structure, such that the vertical insertion plates in a circle are embedded in the slots in a circle, thus realizing a hermetical connection between the anti-blow-by structure and the machine body air inlet.

According to some embodiments of the present disclosure, two opening faces of the anti-blow-by structure are arranged perpendicular to each other, and the anti-blow-by structure further includes an upper top plate and a lower bottom plate which are integrally formed and hermetically arranged with the two opening faces, and a vertical connection face and a special-shaped connection curve which are located between the upper top plate and the lower bottom plate and surround with the two opening faces to form a box body structure.

According to some embodiments of the present disclosure, a distance between the special-shaped connection curve face and the opening face facing the condenser is inwardly narrowed along an air inlet direction.

According to some embodiments of the present disclosure, the vertical connection face and the opening face on the opposite side are arranged in parallel, and the vertical connection face is connected between the special-shaped connection curve and the opening face on one side of the machine body air inlet.

According to some embodiments of the present disclosure, the box body is integrally formed.

The box body forming the anti-blow-by structure is an integrally made plastic box body. All the other parts of the anti-blow-by structure are sealed except for the openings arranged on the two opening faces. The integrally made plastic box body can better ensure a sealing performance during injection molding.

Two opening faces arranged perpendicular to each other in a lateral direction enable a path where air entering the anti-blow-by structure passes through to be shortest. The opening faces arranged perpendicular to each other in a lateral direction are connected by the special-shaped connection curve face and a short section of vertical connection face, and the special-shaped connection curve face is of a gradually narrowed and shrunk structure, such that the space and time for air staying in the anti-blow-by structure can be reduced, and the air can rapidly pass through the anti-blow-by structure and be exhausted through the condenser.

According to some embodiments of the present disclosure, the condenser and the anti-blow-by structure are both located at a lower portion of the air conditioner body, the machine body air inlet is an air inlet duct and the machine body air outlet is an air outlet duct respectively arranged below the air conditioner body, and outer sides of the air inlet duct and the air outlet duct are arranged obliquely from top to bottom.

According to some embodiments of the present disclosure, an air inlet pipe is connected above the air inlet duct and an air exhaust pipe is connected above the air outlet duct. The air inlet pipe and the air exhaust pipe are arranged in parallel with upward air openings.

Air enters the air inlet duct obliquely arranged on one side through the air inlet pipe and then enters the anti-blow-by structure, and the outer side of the air inlet duct is obliquely arranged towards a bottom portion, so that a period for air to pass through the air inlet duct can be reduced.

BRIEF DESCRIPTION OF DRAWINGS

The present disclosure is further described hereinafter with reference to the drawings and the embodiments.

DETAILED DESCRIPTION OF EMBODIMENTS

Figure 1:
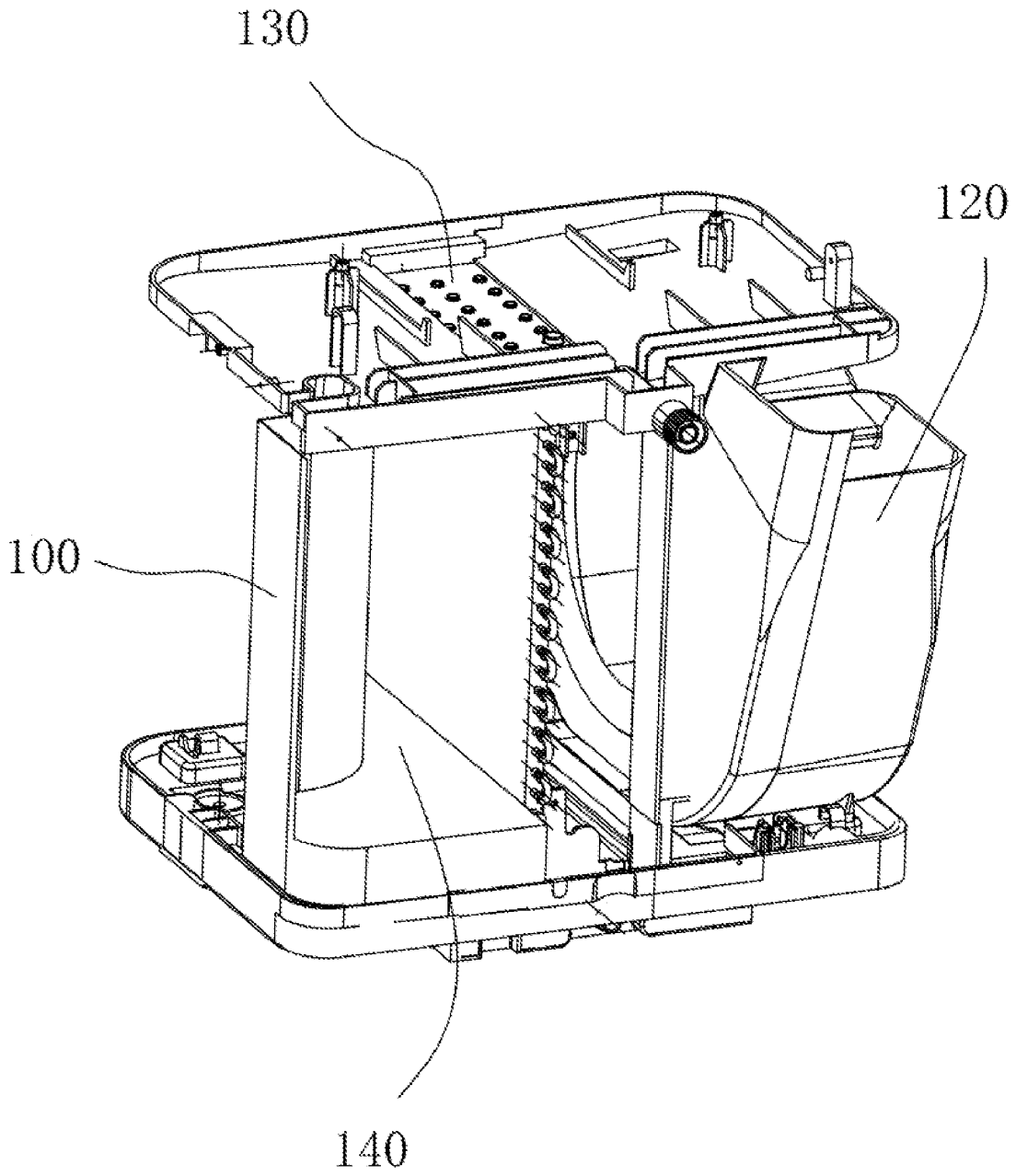
FIG. 1 is a schematic structural diagram of internal assembly according to an embodiment of the present disclosure.
Figure 2:
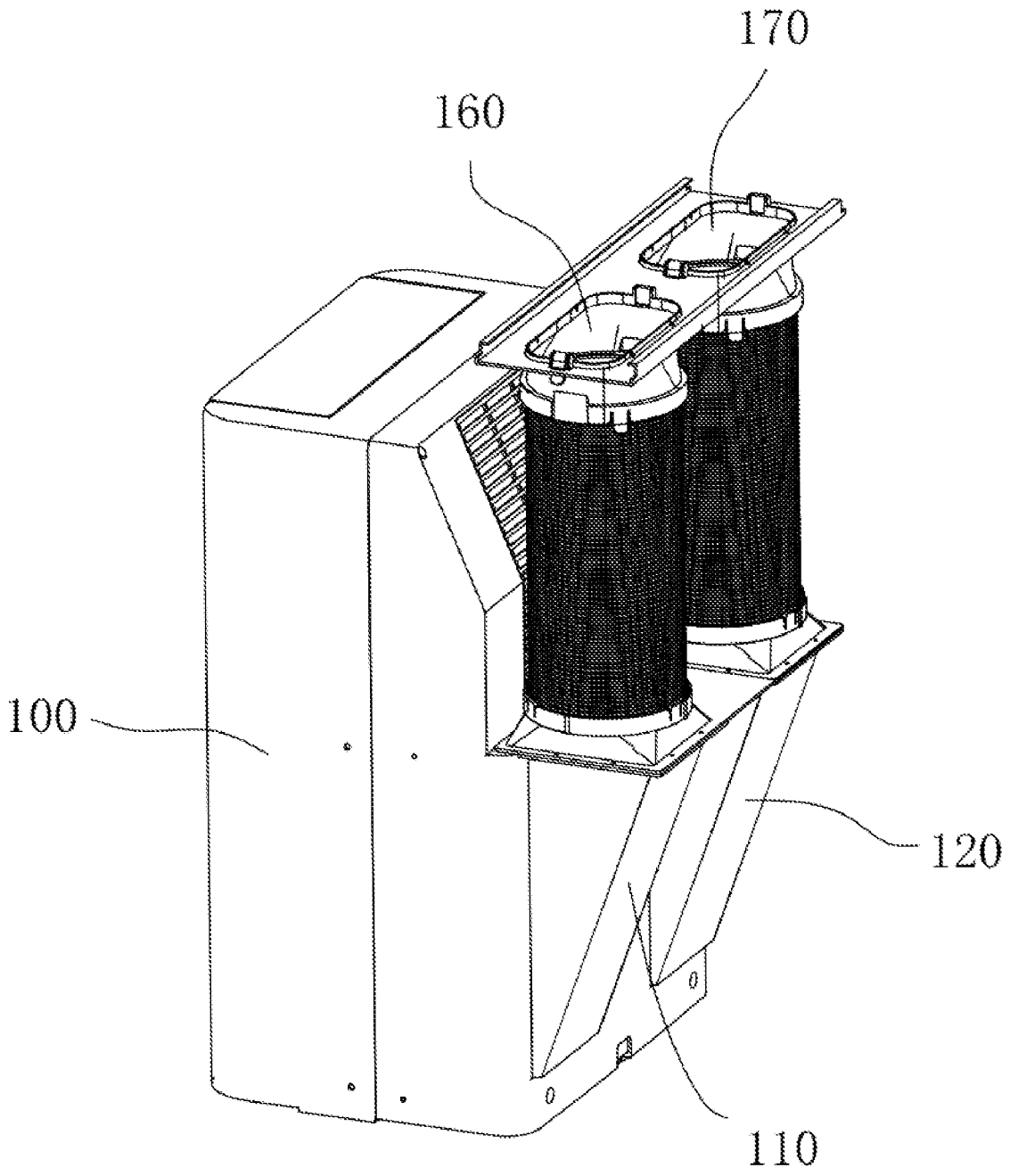
FIG. 2 is an exploded view of an overall structure according to an embodiment of the present disclosure.

Specific embodiments of the present disclosure are described in detail in this section, illustrations of which are shown in the accompanying drawings, where identical or similar reference numerals denote identical or similar elements or elements having the same or similar functions. The embodiments described below by reference to the accompanying drawings are intended only to explain the present disclosure and are not to be construed as limiting the present disclosure.

In the description of the present disclosure, it shall be understood that any orientation/position related description, such as the orientational or positional relationship, such as, up, down, front, rear, left, right, and the like, is based on the orientational or positional relationship shown in the accompanying drawings, is only for the purpose of facilitating the description of the present disclosure and simplifying the description, and does not indicate or imply that the device or element must have a specific orientation or position, be constructed and operated in a specific orientation or position, and therefore shall not be understood as a limitation to the present disclosure.

In the description of the present disclosure, "several" means one or more, "a plurality of" means more than two, and "greater than", "less than", "more than" and the like shall not be understood as including this number, and "above", "below", "within" and the like shall not be understood as including this number. If there are the descriptions of "first" and "second", it is only for the purpose of distinguishing technical features, and shall not be understood as indicating or implying relative importance, implicitly indicating the number of the indicated technical features or implicitly indicating the order of the indicated technical features.

In the description of the present disclosure, words such as setup, installation, and connection shall be understood in a broad sense unless otherwise expressly limited, and a person skilled in the art may reasonably determine the specific meaning of the above words in the present disclosure with reference to the specific context of the technical scheme.

With reference to FIG. 1 to FIG. 6, an integral air conditioner device includes: an air conditioner body 100, where the air conditioner body 100 is provided with a machine body air inlet 110 and a machine body air outlet 120; a condenser 130 mounted in the air conditioner body 100, where a frame of the condenser is arranged around a periphery of the condenser 130; and an anti-blow-by structure 140 arranged between the machine body air inlet 110 and the condenser 130, where the anti-blow-by structure 140 is a box body with two faces opening, one opening 182 of the anti-blow-by structure 140 is in communication with the machine body air inlet 110, another opening 180 of the anti-blow-by structure 140 faces the condenser 130, and the opening 180 of the anti-blow-by structure 140 that facing the condenser 130 is enclosed around the frame of the condenser.

The integral air conditioner device is provided with the anti-blow-by structure 140 between the machine body air inlet 110 and the condenser 130, and the opening 180 of the anti-blow-by structure 140 faces the condenser 130, such that air entering through the machine body air inlet 110 can only pass through the condenser 130 first, and subsequently be exhausted through the machine body air outlet 120. The air conditioner device reduces blow-by during air enters the air conditioner body 100, and can effectively improve a heat dissipation efficiency of the condenser 130.

Figure 3:
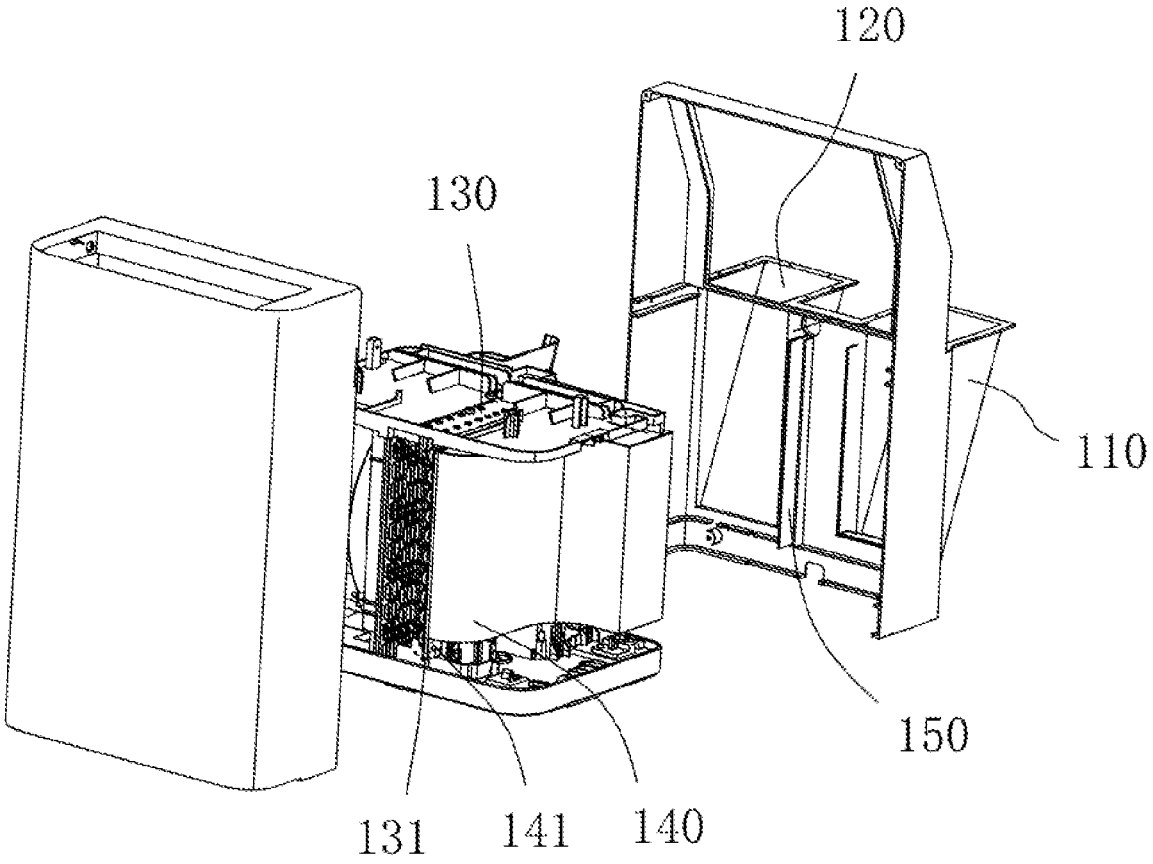
FIG. 3 is an exploded view of the overall structure from another perspective according to an embodiment of the present disclosure.
Figure 5:
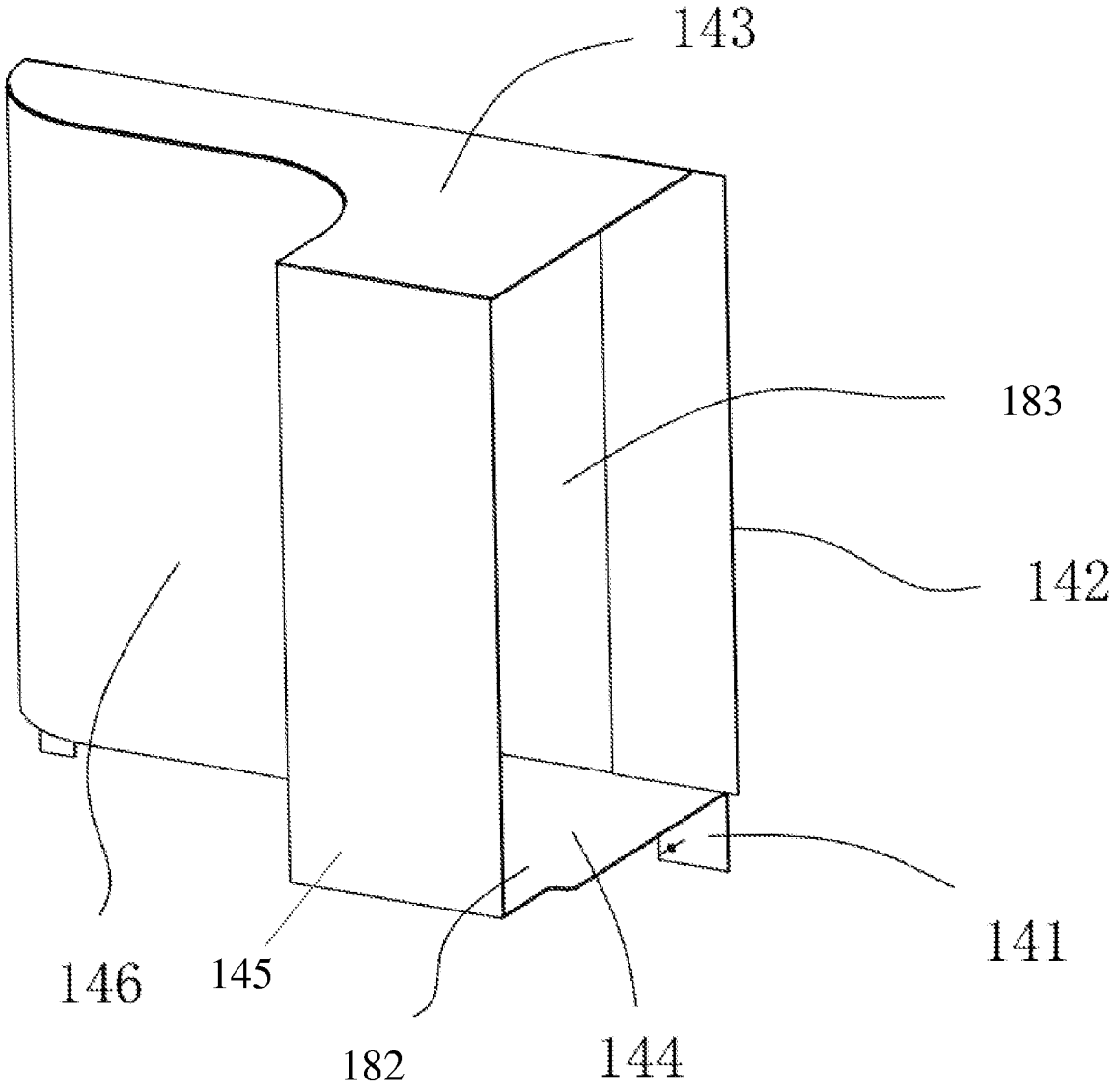
FIG. 5 is a schematic structural diagram of a second perspective of the anti-blow-by structure according to an embodiment of the present disclosure.
Figure 6:
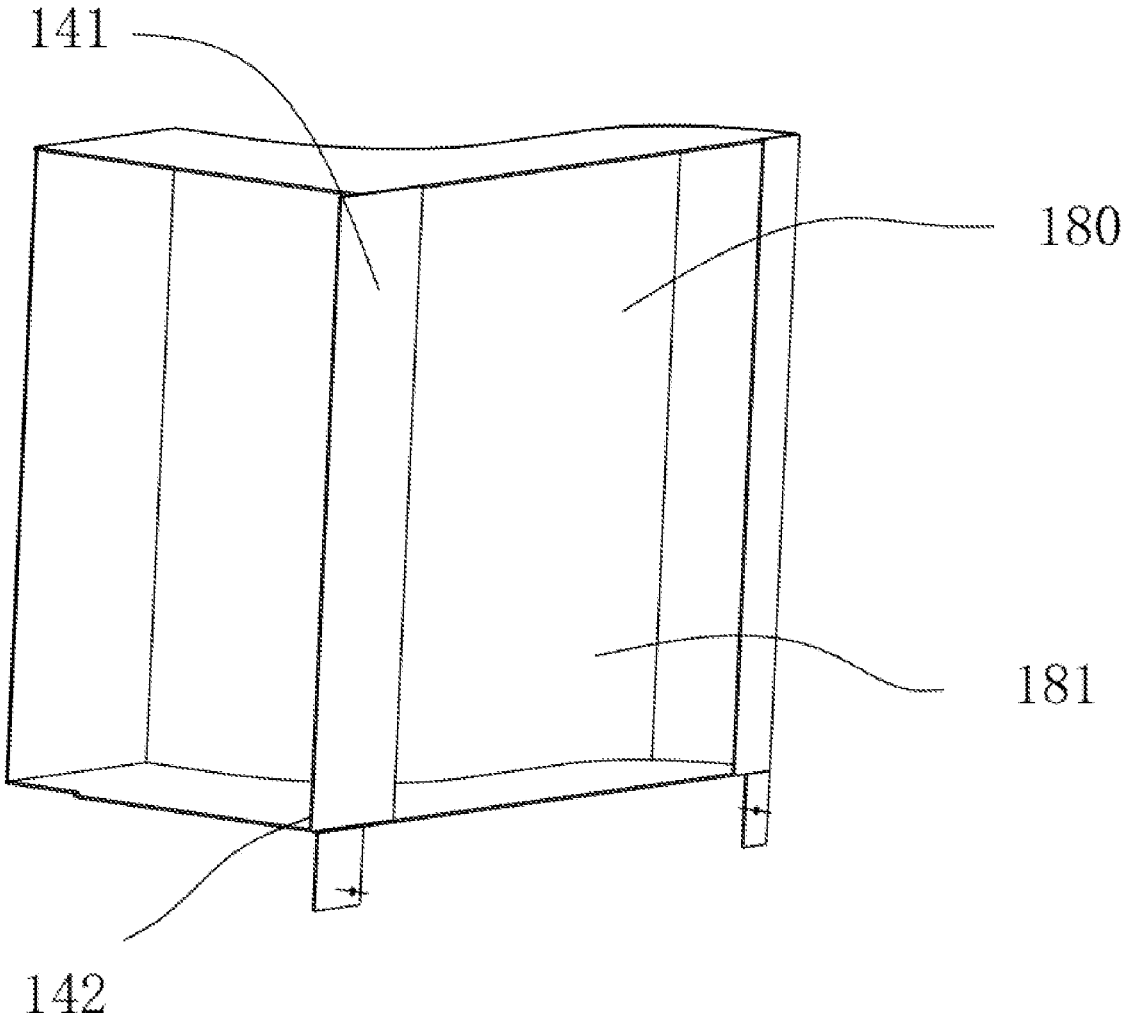
FIG. 6 is a schematic diagram of an overall structure in a completed assembly state according to an embodiment of the present disclosure.

With reference to FIGS. 3, 5 and 6, in some embodiments, the frame of the condenser includes a plurality of first connection edges 131 on a same plane, and the opening 180 of the anti-blow-by structure 140 facing the condenser 130 comprises a plurality of second connection edges 141 around, and the second connection edges 141 are attached and fixed to the first connection edges 131.

In some embodiments, a sealing strip is arranged between the second connection edge 141 and the first connection edge 131 which are attached to each other, and the second connection edge 141 and the first connection edge 131 are fixedly connected.

The opening 180 on one side of the anti-blow-by structure 140 facing the condenser 130 is enclosed around the frame of the condenser, so that air exhausted through the anti-blow-by structure 140 all passes through heat dissipation fins of the condenser 130. When the integral air conditioner device is assembled, it is necessary to ensure a sealing effect between the opening face 181 of the anti-blow-by structure 140 with the condenser 130 and between the opening face 181 of the anti-blow-by structure 140 with the machine body air inlet 110, thus more effectively reducing a possibility of blow-by during air entering through the machine body air inlet 110 from entering to exhausting. When the integral air conditioner device is assembled, the condenser 130 is mounted first, and subsequently the box body forming the anti-blow-by structure 140 is mounted. The opening face 181 on one side of the anti-blow-by structure 140 facing the condenser 130 is attached to and mounted with the first connection edges 131 forming the frame of the condenser by the plurality of second connection edges 141 around the opening 180, which can reduce the blow-by phenomenon occurring at a connection position between the anti-blow-by structure 140 and the condenser 130. In order to strengthen the sealing effect, the sealing strip may be arranged between the first connection edge 131 and the second connection edge 141 which are attached to and mounted with each other, and fixed by screws to simultaneously ensure a connection strength.

Figure 4:
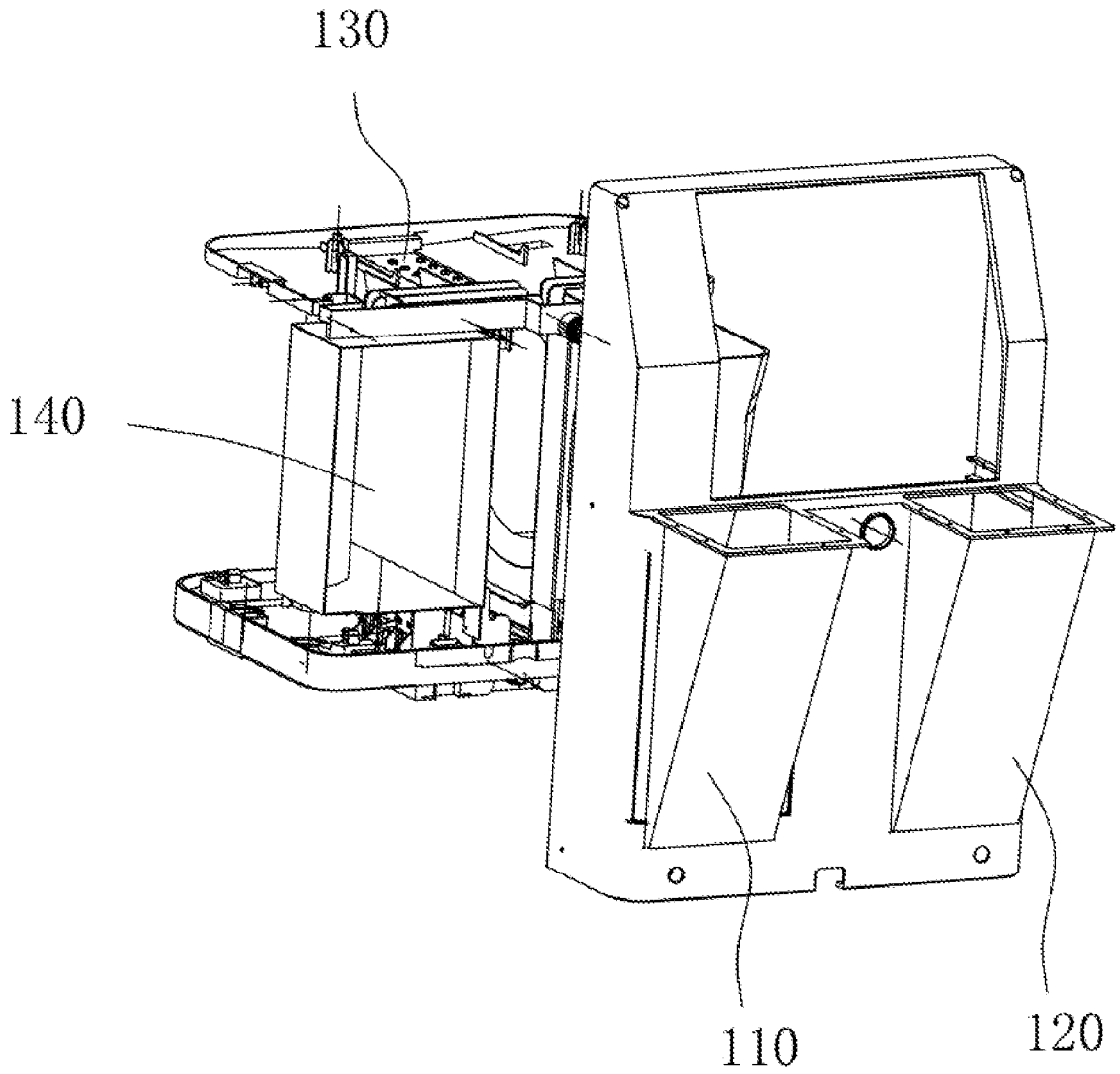
FIG. 4 is a schematic structural diagram of a first perspective of an anti-blow-by structure according to an embodiment of the present disclosure.

With reference to FIG. 4 to FIG. 6, in some embodiments, each side of the opening faces of the box body has an opening respectively. The opening face 183 facing the machine body air inlet 110 on one side of the anti-blow-by structure 140 is provided with a plurality of vertical insertion plates 142, the vertical insertion plates 142 are arranged perpendicular to the opening face 183. The opening face 183 defines an opening 182 in communication with the air inlet 110. A plurality of slots 150 are arranged around the machine body air inlet 110 in the air conditioner body 100, and the vertical insertion plates 142 are respectively embedded in the slots 150 for fixation after the air conditioner body 100 is completely assembled.

The machine body air inlet 110 and the machine body air outlet are arranged on a rear shell of the air conditioner body 100. The rear shell of the air conditioner body 100 is mounted until internal structures such as the condenser 130 and the anti-blow-by structure 140 are completely assembled. When the rear shell of the air conditioner body 100 is mounted, slots 150 arranged on the periphery of the machine body air inlet 110 are aligned with the vertical insertion plates 142 arranged on the anti-blow-by structure 140, such that the vertical insertion plates 142 are respectively embedded in the slots 150 correspondingly arranged on the periphery of the machine body air inlet 110, thus realizing a hermetical connection between the anti-blow-by structure 140 and the machine body air inlet 110.

As a main component of an anti-blow-by structure in the integral air conditioner device, closed mounting of the two opening faces 181 and 183 of the box body forming the anti-blow-by structure 140 is particularly important. One opening face 181 is in closed connection with the condenser 130, and another opening face 183 is also in closed connection with the machine body air inlet 110, such that air may always be in an enclosed air duct during the air enters the air conditioner body 100 from the machine body air inlet 110 and is exhausted from the condenser 130, thus effectively preventing blow-by before the air passes through the condenser 130, and improving a heat dissipation efficiency of the condenser 130.

In some embodiments, two opening faces 181 and 183 of the anti-blow-by structure 140 are arranged perpendicular to each other, and the anti-blow-by structure 140 further includes an upper top plate 143 and a lower bottom plate 144 which are integrally formed and hermetically arranged with the two opening faces 181, and a vertical connection face 145 and a special-shaped connection curve face 146 which are located between the upper top plate 143 and the lower bottom plate 144 and connected with the two opening faces 181 and 183 to form a box body structure.

In some embodiments, a distance between the special-shaped connection curve face 146 and the opening face 181 facing the condenser 130 is inwardly narrowed along an air inlet direction.

In some embodiments, the vertical connection face 145 and the opening face 181 facing the condenser 130 are arranged in parallel, and the vertical connection face 145 is connected between the special-shaped connection curve 146 and the opening face 183 facing the machine body air inlet 110.

In some embodiments, the box body is integrally formed.

The box body forming the anti-blow-by structure 140 is an integrally made plastic box body. All the other parts of the anti-blow-by structure 140 are sealed except for the openings 180 and 180 arranged on the two opening faces 181 and 183, respectively. The integrally made plastic box body can better ensure a sealing performance during injection molding.

Two opening faces 181 and 183, which are arranged perpendicular to each other in a lateral direction, enable a path where air entering the anti-blow-by structure 140 passes through to be shortest. The opening faces 181 and 183, arranged perpendicular to each other in a lateral direction, are connected by the special-shaped connection curve face 146 and a short section of vertical connection face 145, and the special-shaped connection curve face 146 is of a gradually narrowed and shrunk structure such that the space and time for air staying in the anti-blow-by structure 140 can be reduced, and the air can rapidly pass through the anti-blow-by structure 140 and be exhausted through the condenser 130.

In some embodiments, the condenser 130 and the anti-blow-by structure 140 are both located at a lower portion of the air conditioner body 100, the machine body air inlet 110 is an air inlet duct and the machine body air outlet 120 is an air outlet duct respectively arranged below the air conditioner body 100, and outer sides of the air inlet duct and the air outlet duct are arranged obliquely from top to bottom.

In some embodiments, an air inlet pipe 160 is connected above the air inlet duct and an air exhaust pipe 170 is connected above the air outlet duct. The air inlet pipe 160 and the air exhaust pipe 170 are arranged in parallel with upward air openings.

Air enters the air inlet duct obliquely arranged on one side through the air inlet pipe 160 and then enters the anti-blow-by structure 140, and the outer side of the air inlet duct is obliquely arranged towards a bottom portion, so that a period for air to pass through the air inlet duct can be reduced.

The embodiments of the present disclosure have been described in detail above with reference to the accompanying drawings, but the present disclosure is not limited to the embodiments described above, and various changes may be made without departing from the spirits of the present disclosure within the scope of knowledge possessed by those of ordinary skill in the art.

What is claimed is:

1. An integral air conditioner device comprising:

an air conditioner body provided with an air inlet and an air outlet;

a condenser provided in the air conditioner body; and an anti-blow-by structure arranged between the air inlet and the condenser, wherein the anti-blow-by structure comprises a box body, wherein the box body comprises an upper top plate, a lower bottom plate, a vertical insertion plate, a vertical connection face and a curved connection face, wherein the upper top plate, the lower bottom plate, the vertical insertion plate and the vertical connection face define a first opening face in communication with and facing the air inlet, wherein the upper top plate, the lower bottom plate, the vertical insertion plate and the curved connection face define a second opening face in communication with and facing the condenser, wherein the first opening face and the second opening face are arranged perpendicular to each other, wherein the curved connection face extends away from the vertical connection face in an air inlet direction, and wherein a distance between the curved connection face and the second opening face is inwardly narrowed along the air inlet direction such that an inward narrowing of the distance in a first portion of the curved connection face adjacent to the vertical connection face is greater than an inward narrowing of the distance in a second portion of the curved connection face adjacent to the second opening face.

2. The integral air conditioner device according to claim 1, wherein a frame of the condenser comprises a plurality of first connection edges on a same plane, wherein a portion of the box body adjacent to the second opening face facing the condenser comprises a plurality of second connection edges, and wherein the plurality of second connection edges are fixedly attached to the plurality of first connection edges, respectively.

3. The integral air conditioner device according to claim 2, wherein a sealing strip is arranged between one of the second connection edges and one of the first connection edges fixedly attached to the one of the second connection edges.

4. The integral air conditioner device according to claim 1, wherein a slot is arranged on a periphery of the air inlet in the air conditioner body, and wherein the vertical insertion plate is inserted into the slot for fixation.

5. The integral air conditioner device according to claim 1, wherein the vertical connection face and the second opening face facing the condenser are arranged in parallel, and wherein the vertical connection face is connected between the curved connection face and the first opening face facing the air inlet.

6. The integral air conditioner device according to claim 1, wherein the box body is integrally formed.

7. The integral air conditioner device according to claim 1, wherein the condenser and the anti-blow-by structure are both located at a lower portion of the air conditioner body, wherein the air inlet comprises an air inlet duct and the air outlet comprises an air outlet duct respectively arranged below the air conditioner body, and wherein outer sides of the air inlet duct and the air outlet duct are arranged obliquely from top to bottom.

8. The integral air conditioner device according to claim 7, further comprising:

an air inlet pipe connected above the air inlet duct and an air exhaust pipe connected above the air outlet duct, wherein the air inlet pipe and the air exhaust pipe are arranged in parallel with upward air openings.

* * * * *